US011250833B1

(12) United States Patent
Bajic et al.

(10) Patent No.: US 11,250,833 B1
(45) Date of Patent: Feb. 15, 2022

(54) METHOD AND SYSTEM FOR DETECTING AND MITIGATING AUDIO HOWL IN HEADSETS

(71) Applicant: Apple Inc., Cupertino, CA (US)

(72) Inventors: Vladan Bajic, San Francisco, CA (US); Hanchi Chen, San Jose, CA (US); Vasu Iyengar, Pleasanton, CA (US); Yang Lu, San Jose, CA (US); Navneet Gandhi, Santa Clara, CA (US); Thomas M. Jensen, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/023,278

(22) Filed: Sep. 16, 2020

(51) Int. Cl.
*G10K 11/178* (2006.01)
*H04R 1/10* (2006.01)

(52) U.S. Cl.
CPC .. *G10K 11/17854* (2018.01); *G10K 11/17875* (2018.01); *H04R 1/1008* (2013.01); *G10K 2210/1081* (2013.01); *G10K 2210/3026* (2013.01); *G10K 2210/3028* (2013.01); *G10K 2210/3044* (2013.01); *G10K 2210/3056* (2013.01)

(58) Field of Classification Search
CPC ..... H04R 3/02; H04R 25/453; H04R 25/45; G10K 11/17879; G10K 11/17881; G10K 11/17819; G10K 2210/506
See application file for complete search history.

(56) References Cited

U.S. PATENT DOCUMENTS 8,116,490 B2 * 2/2012 Puder ..... H04R 25/552 381/318

* cited by examiner

*Primary Examiner* — Kile O Blair
(74) *Attorney, Agent, or Firm* — Womble Bond Dickinson (US) LLP

(57) ABSTRACT

A method performed by an audio system that includes a headset with a left headset housing and a right headset housing. The method includes driving a speaker of the left headset housing with an audio signal, determining whether audio howl is present within the left headset housing by comparing spectral content from a first error microphone signal produced by a first error microphone of the left headset housing and spectral content from a second error microphone signal produced by a second error microphone of the right headset housing, and, in response to determining that audio howl is present, filtering the audio signal to mitigate the audio howl.

21 Claims, 8 Drawing Sheets

METHOD AND SYSTEM FOR DETECTING AND MITIGATING AUDIO HOWL IN HEADSETS

FIELD

An aspect of the disclosure relates to detecting and mitigating audio howl in headsets. Other aspects are also described.

BACKGROUND

Headphones are an audio device that includes a pair of speakers, each of which is placed on top of a user's ear when the headphones are worn on or around the user's head. Similar to headphones, earphones (or in-ear headphones) are two separate audio devices, each having a speaker that is inserted into the user's ear. Both headphones and earphones are normally wired to a separate playback device, such as an MP3 player, that drives each of the speakers of the devices with an audio signal in order to produce sound (e.g., music). Headphones and earphones provide a convenient method by which the user can individually listen to audio content without having to broadcast the audio content to others who are nearby.

SUMMARY

An aspect of the disclosure is a method performed by an audio system to detect and mitigate audio howl. The system includes a headset, such as an over-the-ear headset (or headphones) with a left headset (or headphone) housing and a right headset housing. In one aspect, the method may be performed by (e.g., a programmed processor of) each headset housing in order to reduce the effects of audio howl in each individual housing. For instance, the audio system may detect and mitigate audio howl in the left headset housing as follows. The system drives a speaker of the left headset housing with an audio signal. The system determines whether audio howl is present within the left headset housing by comparing spectral content from a first error microphone signal produced by a first error microphone of the left headset housing and spectral content from a second error microphone signal produced by a second error microphone of the right headset housing, and, in response to determining that audio howl is present, filtering the audio signal to mitigate the audio howl. As described herein, this process may be performed by each individual headset housing. In which case, audio signals being outputted by speakers of the left and right headset housing may be individually filtered based on whether audio howl is present in each respective headset housing.

In one aspect, the audio system may detect and mitigate audio howl that is caused while the system operates in one of several audio output modes. For instance, the system may include an ambient sound enhancement (ASE) mode in which each headset housing reproduces ambient sound captured by one or more reference microphones. Specifically, for the left headset housing, the system may generate the audio signal by filtering a reference microphone signal produced by a reference microphone of the left headset housing with an ASE filter. The audio howl may be "feed-forward" audio howl, which is produced as a result of acoustic coupling between the reference microphone and the left headset housing's speaker in which sound produced by the speaker is picked up by the reference microphone. As another example, the system may include an acoustic noise cancellation (ANC) mode. In this mode, the system may generate an anti-noise signal as the audio signal by filtering the first error microphone signal produced by the first error microphone (e.g., with an ANC filter). The audio howl may be "feedback" audio howl, which is produced as a result of a positive feedback loop between the speaker and the first error microphone of the left headset housing.

In another aspect, the system may remove sounds contained within the first error microphone signal when detecting whether audio howl is present. In particular, the system obtains an input audio signal that contains user-desired audio content (e.g., music), and drives the speaker (of the left headset housing) with a combination of the audio signal (e.g., an anti-noise signal and/or an ASE filtered audio signal) and the input audio signal to produce sound, where the first error microphone is arranged to capture and convert the sound into the first error microphone signal. The system processes the first error microphone signal to remove sound of the input audio signal produced by the speaker to produce an error signal. The determination of whether audio howl is present is based on a comparison of spectral content from the error signal and spectral content from the second error microphone signal. In one aspect, the second error microphone signal may also be a processed signal in which case the (e.g., right headset housing of the) audio system has removed another input audio signal that is used to drive the right headset housing's speaker.

In some aspects, the system may determine whether audio howl is present based on a comparison of audio howl candidates. Specifically, for the left headset housing, the system generates, using the first error microphone signal, a first audio howl candidate that represents spectral content from the first error microphone signal over a frequency range. For instance, the audio howl candidate may be a data structure that includes audio data, such as a magnitude (e.g., sound pressure level (SPL) and corresponding frequency range of at least a portion of the signal's spectral content. The system compares the first audio howl candidate with a second audio howl candidate representing spectral content from the second error microphone signal over the same frequency range, and determines whether the spectral content of the first audio howl candidate differs from the spectral content of the second audio howl candidate by a (first) threshold. In particular, the system determines whether a first SPL across the frequency range of the first audio howl candidate is greater than a second SPL across the frequency range of the second audio howl candidate by the first threshold.

In one aspect, each headset housing may generate its respective audio howl candidate. Specifically, the first audio howl candidate is generated by the left headset housing and the second audio howl candidate is generated by the right headset housing. In this case, the (e.g., left headset housing of the) audio system may obtain the second audio howl candidate from the right headset housing (e.g., via a wireless computer network) to be used to determine whether audio howl is present within the left headset housing. In another aspect, each headset housing may generate both audio howl candidates. For example, the left headset housing may obtain, from the right headset housing, the second error microphone signal and generate, using the second error microphone signal, the second audio howl candidate.

In one aspect, the audio system mitigates the audio howl based on the spectral content of the error microphone signals. In response to determining that audio howl is present, the system determines whether a SPL of the spectral content from the first error microphone signal (e.g., the SPL of the first audio howl candidate) exceeds a (second) threshold. In response to the SPL exceeding the second threshold, the system determines a band-limited filter with a gain reduction based on the SPL of the spectral content from the first error microphone signal and generates a filtered audio signal by filtering the audio signal with the band-limited filter. In one aspect, the spectral content form the first error microphone signal is within a frequency range, and the band-limited filter has a limit-band across the same frequency range over which the gain reduction is applied to the audio signal. In another aspect, in response to the SPL being below the threshold, the system generates a filtered audio signal as a gain-reduced audio signal by applying a (e.g., broadband) scalar gain to the audio signal.

The above summary does not include an exhaustive list of all aspects of the disclosure. It is contemplated that the disclosure includes all systems and methods that can be practiced from all suitable combinations of the various aspects summarized above, as well as those disclosed in the Detailed Description below and particularly pointed out in the claims. Such combinations may have particular advantages not specifically recited in the above summary.

BRIEF DESCRIPTION OF THE DRAWINGS

The aspects are illustrated by way of example and not by way of limitation in the figures of the accompanying drawings in which like references indicate similar elements. It should be noted that references to "an" or "one" aspect of this disclosure are not necessarily to the same aspect, and they mean at least one. Also, in the interest of conciseness and reducing the total number of figures, a given figure may be used to illustrate the features of more than one aspect, and not all elements in the figure may be required for a given aspect.

DETAILED DESCRIPTION

Figure 1:
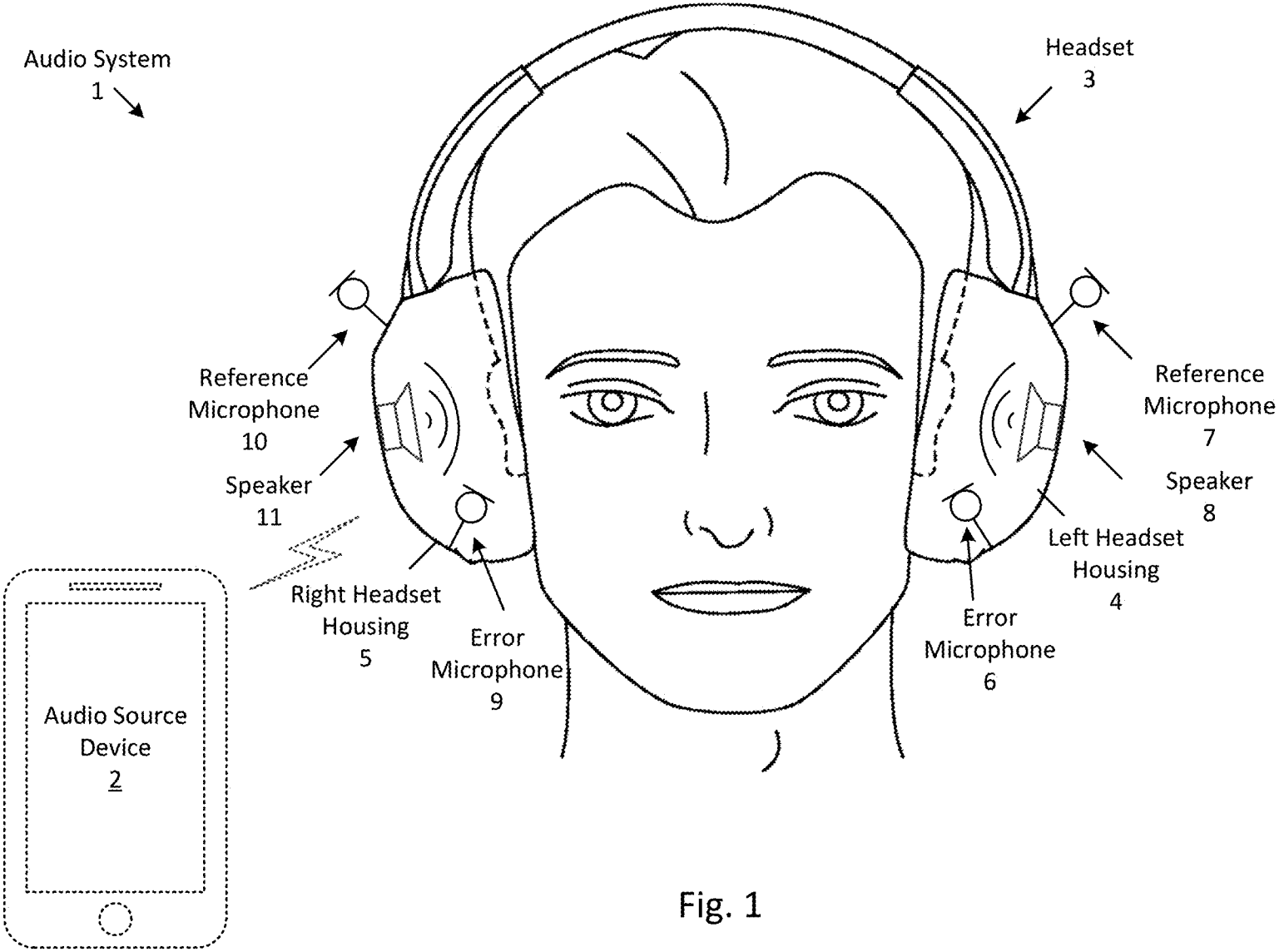
FIG. 1 shows an audio system with a headset according to one aspect.

Several aspects of the disclosure with reference to the appended drawings are now explained. Whenever the shapes, relative positions and other aspects of the parts described in a given aspect are not explicitly defined, the scope of the disclosure here is not limited only to the parts shown, which are meant merely for the purpose of illustration. Also, while numerous details are set forth, it is understood that some aspects may be practiced without these details. In other instances, well-known circuits, structures, and techniques have not been shown in detail so as not to obscure the understanding of this description. Furthermore, unless the meaning is clearly to the contrary, all ranges set forth herein are deemed to be inclusive of each range's endpoints.

Audio howl (or audio feedback) is an undesirable audio effect that occurs in an audio system in which a positive sound loop exists between an audio input source (e.g., a microphone) and an audio output source (e.g., a speaker). In this loop, sound produced by a speaker is captured by the microphone as a microphone signal, which is then amplified (e.g., by an audio amplifier) to create an output audio signal that is used to drive the speaker. This loop is repeated and happens so quickly that it creates its own frequency, which results in a howling sound. Some current audio systems detect audio howl in order to reduce its effects. Specifically, these systems may perform a spectral analysis upon the microphone signal to detect characteristics of audio howl. For example, the systems may determine whether certain spectral features (e.g., arising within predefined frequency ranges) are present within the signal. Once audio howl is identified, notch filters are applied to the (e.g., output audio) signal, each of which having a stop-band across a different frequency range. Conventional audio howl detection methods, however, are prone to detecting false positives. For instance, some ambient sounds that are picked up by the microphone may have similar spectral features to audio howl. As a result, these systems may erroneously apply notch filters, which may adversely affect the user experience (e.g., by attenuating spectral content that should not otherwise be attenuated).

To overcome these deficiencies, the present disclosure describes an audio system that includes a headset with a left headset housing and a right headset housing, which is capable of accurately detecting audio howl. As described herein, conventional howl detection methods analyze the signal within a positive closed-loop system that includes a microphone and a speaker. The present disclosure is an audio system that detects audio howl by comparing a microphone signal of the closed-loop system in which the system is detecting for audio howl, with another "reference" microphone signal that is not a part of the closed-loop system. Specifically, the system determines whether audio howl is present within one (or both) of the headset housings (e.g., the left headset housing) by comparing spectral content from a first error microphone signal produced by an error microphone of the left headset housing with a second error microphone signal produced by an error microphone of the other (e.g., right) headset housing of the headset. Based on the comparison, the system may determine that the left headset housing has audio howl when the spectral content is dissimilar (e.g., the spectral content of the first error microphone signal having a magnitude that is larger than the spectral content of the second error microphone signal). On the other hand, the system may determine that there isn't (or a less likelihood of) audio howl when the spectral content is similar (or the same). In this case, the spectral content may be similar because both microphones of the headset are capturing the same ambient sound (e.g., a running washer machine). Thus, the audio system of the present disclosure accurately and effectively detects audio howl, thereby reducing false positives.

As described herein, to reduce audio howl conventional systems may apply notch filters. For example, these systems may include a notch filter bank, where each notch filter has a stop-band across a different predefined frequency range. Once audio howl is detected, the systems applies the notch filters. Since the notch filters attenuate predefined frequency ranges, their application may attenuate spectral content unaffected by the audio howl. Therefore, there is a need for an adaptive band-limited filter for mitigating audio howl, which is generated based on the error microphone signal.

To overcome these deficiencies, the audio system of the present disclosure mitigates audio howl by applying a band-limited filter to the output audio signal (e.g., the signal driving the speaker), where the filter is generated based on the error microphone signal. Specifically, upon determining that audio howl is present, the system determines whether the magnitude (e.g., sound pressure level (SPL)) of the spectral content from the first error microphone signal exceeds a threshold. If so, the system determines a band-limited filter with a gain reduction based on the SPL of the spectral content, where the gain reduction is applied over a limit-band that is across a frequency range of the spectral content. In particular, the gain reduction is based on a difference between the SPL and a SPL threshold. Thus, the band-limited filter is adapted based on the spectral content of the audio howl. If, however, the SPL does not exceed the threshold, the system may apply a (e.g., broadband) scalar gain to the signal. This is in contrast to conventional approaches in which notch filters with stop-bands across predefined frequency ranges are applied.

FIG. 1 shows an audio system 1 with a headset 3 according to one aspect. The system also (optionally) includes an audio source device 2 (illustrated as a smart phone). In one aspect, the audio system may include other devices, such as a remote electronic server (not shown) that may be communicatively coupled to either the audio source device or the headset. In one aspect, this remote electronic server may perform at least some of the audio howl detection and mitigation operations described herein.

As illustrated, the headset 3 is an over-the-ear headset (or headphones) that is shown to be at least partially covering both of the user's ears and is arranged to direct sound into the ears of the user. Specifically, the headset includes two headset (or headphone) housings, a left headset housing 4 that is arranged to direct sound produced by one or more speakers 8 (e.g., electrodynamic drivers) into the user's left ear, and a right headset housing 5 that is arranged to direct sound produced by one or more speakers 11 into the user's right ear. Each headset housing includes at least one reference microphone and at least one error microphone. In one aspect, the microphones may be any type of microphone (e.g., a differential pressure gradient micro-electro-mechanical system (MEMS) microphone) that is arranged to convert acoustical energy caused by sound waves propagating in an acoustic environment into a microphone signal. In particular, the left housing includes reference microphone 7 and the right housing includes reference microphone 10. Each reference microphone may be an "external" microphone that is arranged to capture sound from the ambient environment as a (e.g., reference) microphone signal. In particular, reference microphone 7 is arranged to capture ambient sound proximate to the user's left ear and reference microphone 10 is arranged to capture ambient sound proximate to the user's right ear. In addition, the left housing includes error microphone 6 and the right housing includes error microphone 9, where each error microphone may be an "internal" microphone that is arranged to capture sound (e.g., and/or sense pressure changes) inside each respective housing. For example, while the headset 3 is being worn by the user, each housing creates a front volume that is formed between (e.g., a cushion of) the housing and at least a portion of the user's head. Thus, error microphone 6 is arranged to capture sound within the left headset housing's front volume, which may include sound produced by the speaker 8 and/or any background sound that has entered the front volume (e.g., sound that has penetrated through the housing and/or sound that has entered the front volume via a cavity that may be formed between the user's head and the housing's cushion).

In one aspect, the headset 3 may include more or less components. For example, the headset 3 may include one or more "extra-aural" speakers that may be arranged to project sound directly into the ambient environment. For instance, the left headset housing 4 may include an array of (two or more) extra-aural speakers that are configured to project directional beam patterns of sound at locations within the environment, such as directing beams towards the user's ears. In some aspects, the headset may include a sound output beamformer (e.g., where one or more processors of the headset is configured to perform beamformer operations) that is configured to receive one or more input audio signals (e.g., a playback signal) and is configured to produce speaker driver signals which when used to drive the two or more extra-aural speakers, may produce spatially selective sound output in the form of one or more sound output beam patterns, each pattern containing at least a portion of the input audio signals.

In another aspect, the headset may be any electronic device that includes at least one speaker, at least one reference microphone, and/or at least one error microphone, and is arranged to be worn by the user (e.g., on the user's head). For example, the headset may be on-the-ear headphones or (one or more) in-ear headphones (earphones or earbuds). In this case, the in-ear headphone may include a first (or left) in-ear headphone housing and/or a second (or right) in-ear headphone housing. In one aspect, the headset may be one or more wireless earbuds. In the case of in-ear headphones, where each headphone is arranged to be positioned on (or in) a respective ear of the user, the error microphone may be arranged to capture sound within the user's ear (or ear canal).

The audio source device 2 is illustrated as a multimedia device, more specifically a smart phone. In one aspect, the source device may be any electronic device that can perform audio signal processing operations and/or networking operations. An example of such a device may include a tablet computer, a laptop, a desktop computer, a smart speaker, etc. In one aspect, the source device may be a portable device, such as a smart phone as illustrated. In another aspect, the source device may be a head-mounted device, such as smart glasses, or a wearable device, such as a smart watch.

As shown, the audio source device 2 is communicatively coupled to the headset 3, via a wireless connection. For instance, the source device may be configured to establish a wireless connection with the headset via any wireless communication protocol (e.g., BLUETOOTH protocol). During the established connection, the source device may exchange (e.g., transmit and receive) data packets (e.g., Internet Protocol (IP) packets) with the headset, which may include audio digital data. In another aspect, the source device may be coupled via a wired connection. In some aspects, the audio source device may be a part of (or integrated into) the headset. For example, as described herein, at least some of the components (e.g., at least one processor, memory, etc.) of the audio source device may be a part of the headset. As a result, at least some (or all) of the operations to detect and/or mitigate audio howl may be performed by the audio source device, the headset, or a combination thereof.

As described herein, FIGS. 2A-3B show block diagrams of detecting and mitigating audio howl. The operational blocks shown in these figures and described herein that perform audio digital signal processing operations may all be implemented (e.g., as software that is executed) by the controller 15 (which may include one or more programmed digital processors (generically referred to herein as "a processor")) that executes instructions stored in memory (e.g., of the controller 15). For example, these figures illustrate operations being performed by the controller 15 of the left headset housing for detecting and mitigating howl for the left headset housing. In another aspect, however, at least some of these operations may be performed by a controller (or at least one processor) of the right headset housing for detecting and mitigating howl for the right headset housing, as described herein. In another aspect, the controller 15 may be shared between the left and right headset housings, such that the controller performs operations for detecting and mitigating howl one or both of the housings. More about both of the housings performing these operations is described in FIGS. 4-6.

In one aspect, the left and right headset housings 4 and 5 may be communicatively coupled to one another. For example, (e.g., controllers of) both housings may be coupled via a wire connection (e.g., through a headband that couples both housings together. In another aspect, both housings may be coupled via a wireless connection (e.g., BLUETOOTH). For example, when the headset is a pair of wireless earphones, both earphones (each with a respective headset housing) may establish a wireless connection with each other in order to exchange data.

Figure 2A:
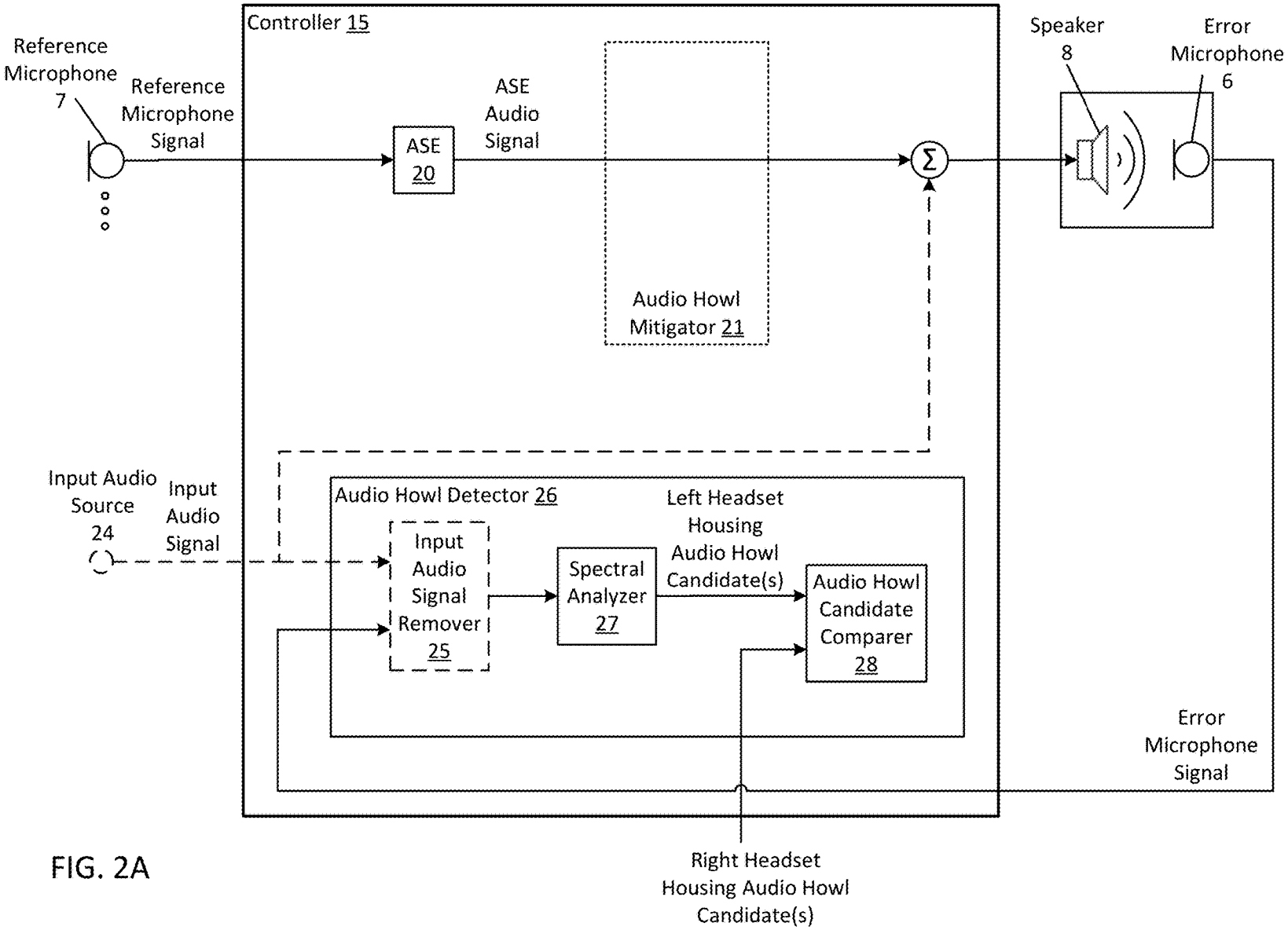
FIGS. 2A and 2B show block diagrams of a left headset housing that performs audio howl detection and mitigation according to one aspect.
Figure 2B:
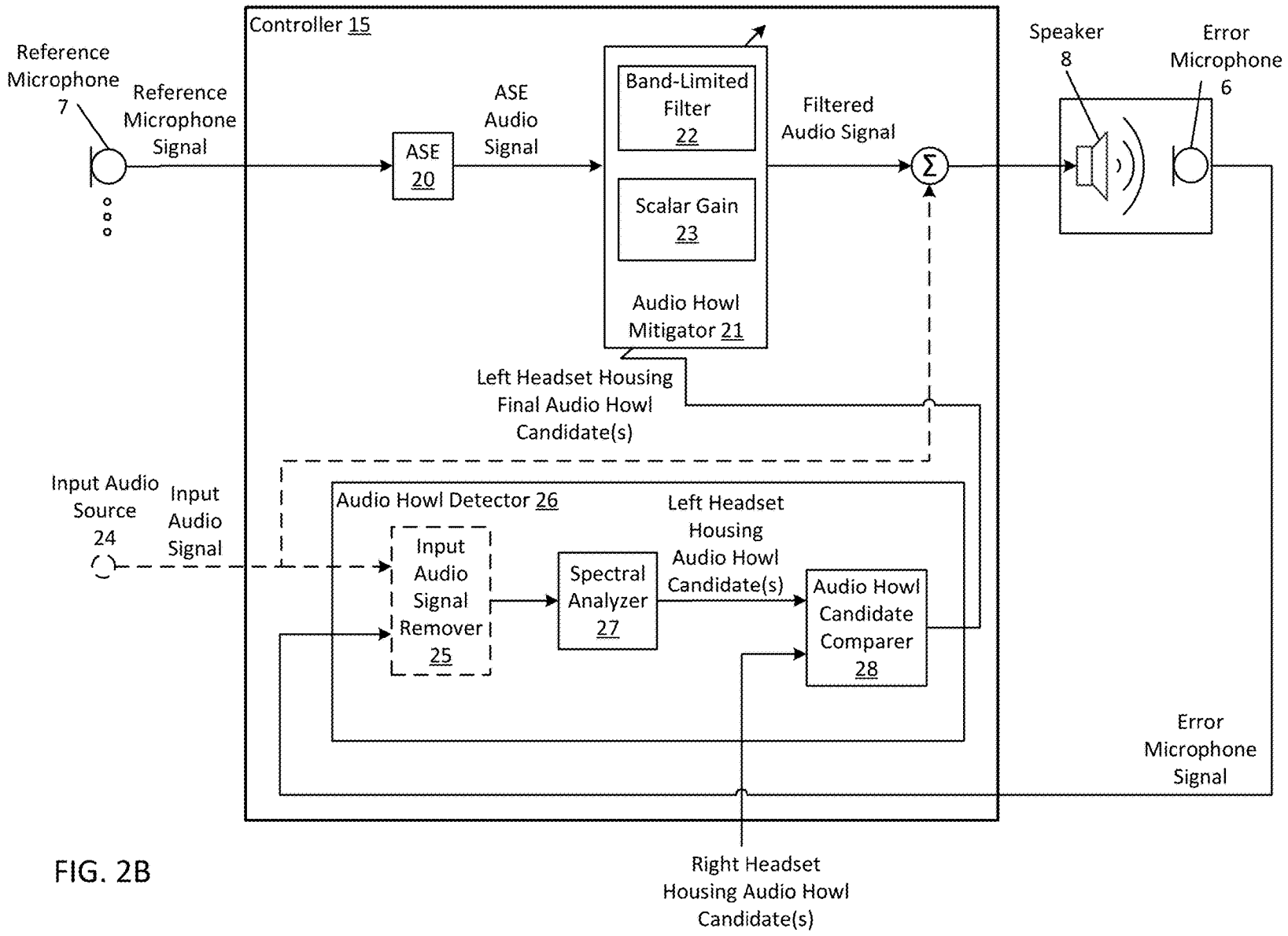

Turning now to FIGS. 2A and 2B, these figures show block diagrams of howl detection and mitigation operations performed by the controller 15 of the left headset housing (e.g., housing 4) according to one aspect. Specifically, FIG. 2A shows operations performed by several computational blocks for detecting audio howl, and FIG. 2B shows operations performed by several blocks for mitigating the detected audio howl. These diagrams include one or more reference microphones 7, a controller 15, an input audio source 24, one or more speakers 8, and one or more error microphones 6.

The controller 15 may be a special-purpose processor such as an application-specific integrated circuit (ASIC), a general purpose microprocessor, a field-programmable gate array (FPGA), a digital signal controller, or a set of hardware logic structures (e.g., filters, arithmetic logic units, and dedicated state machines). The controller is configured to perform howl detection and mitigation operations, as described herein. The controller includes several operational blocks, such as an ambient sound enhancement (ASE) block 20, an audio howl mitigator (or howl mitigator) 21 (which is not in the signal path in FIG. 2A), and an audio howl detector (or howl detector) 26. A discussion of the operational blocks is as follows.

The ASE 20 is configured to perform an ASE function for reproducing ambient sound (e.g., captured by the reference microphone 7) in a "transparent" manner, e.g., as if the headset 3 was not being worn by the user. The ASE is configured to obtain a reference microphone signal (that contains ambient sound) from the reference microphone 7, and filter the signal (e.g., with one or more audio processing filters) to reduce acoustic occlusion due to the headset housing covering the user's ear (and/or due to the headset housing blocking the entrance of the user's ear canal when the headset housing is a part of a wireless earbud). In particular, the ASE is configured to produce an ASE audio signal (by filtering the reference microphone signal), which when used to drive the speaker 8 reproduces (at least some of) the ambient sounds captured by reference microphone. In one aspect, the ASE block may filter the reference microphone signal such that at least one sound of the ambient environment is selectively attenuated (e.g., not reproduced by the speaker). In one aspect, the ASE may fully attenuate (e.g., duck) one or more sounds, or the sounds may be partially attenuated such that an intensity (e.g., SPL) of the sound is reduced (e.g., by a percentage value, such as 50%). For instance, the ASE may reduce a sound level of the reference microphone signal. In one aspect, the ASE may be composed of a cascade of digital filters that spectrally shape the ambient sound pickup channel for purposes of different types of noise suppression, e.g., microphone noise, background noise, and wind. In addition, the cascade of digital filters may include blocks that perform dynamic range compression and spectral shaping that are tuned for compensating the user's hearing loss.

In one aspect, the ASE 20 may also preserve the spatial filtering effect of the wearer's anatomical features (e.g., head, pinna, shoulder, etc.). In one aspect, the ASE may also help preserve the timbre and spatial cues associated with the actual ambient sound. Thus, in one aspect, the ASE (or more specifically ASE filters used to filter the reference microphone signal) may be user-specific according to specific measurements of the user's head (which may be determined based on user input or may be determined automatically by the audio system). For instance, the system may determine the ASE filters according to a head-related transfer function (HRTF) or, equivalently, head-related impulse response (HRIR) that is based on the user's anthropometrics.

In one aspect, the headset 3 (e.g., the left headset housing 4) may include a microphone array of two or more reference microphones 7 (while the right headset housing 5 may include another microphone array of reference microphones 10). Specifically, a processor of the left headset housing may perform a sound pickup beamformer algorithm that is configured to process the microphone signals to form one or more directional beam patterns as beamformer audio signals for spatially selective sound pickup in certain directions, so as to be more sensitive to one or more sound source locations. In this case, the ASE 20 may obtain one or more beamformer audio signals, each associated with at least one directional beam pattern to apply ASE operations, as described herein.

The input audio source 24 may include a programmed processor that is running a media player software application and may include a decoder that is producing an input audio signal as digital audio input. In one aspect, the input audio signal may include user-desired program audio (e.g., music). In another aspect, the programmed processor may be a part of the audio source device 2 and/or the (e.g., left headset housing 4 of the) headset 3, such that the media player is executed within the device. In another aspect, the media player may be executed by (e.g., one or more programmed processors of) another electronic device. In this case, the electronic device executing the media player may (e.g., wirelessly) transmit the input audio signal to the headset. In some aspects, the decoder may be capable of decoding an encoded audio signal, which has been encoded using any suitable audio codec, such as, e.g., Advanced Audio Coding (AAC), MPEG Audio Layer II, MPEG Audio Layer III, or Free Lossless Audio Codec (FLAC). Alternatively, the input audio source 30 may include a codec that is converting an analog or optical audio signal, from a line input, for example, into digital form for the controller. Alternatively, there may be more than one input audio channel, such as a two-channel input, namely left and right channels of a stereophonic recording of a musical work, or there may be more than two input audio channels, such as for example the entire audio soundtrack in 5.1-surround format of a motion picture film or movie. In one aspect, the input source 24 may provide a digital input or an analog input. In one aspect, when the user-desired audio content includes multiple input audio channels, each headset housing may obtain a different (or similar) channel. For example, when the audio content is a stereophonic recording the left headset housing may obtain a left audio channel as the input audio signal and the right headset housing may obtain a right audio channel as its input audio signal.

As described herein, the input audio signal may contain program audio, such as music, a podcast, or a movie soundtrack. In one aspect, the input audio signal may include other audio content. For example, the input audio signal may include a downlink signal that is obtained by the audio system during a telephone call with another electronic device.

In one aspect, the audio system 1 may operate in one of several audio output modes. In this figure, the system is operating in an ASE mode (first mode) in which the (e.g., headset housings of the) headset perform ASE operations, as described herein in order to produce one or more ASE audio signals for driving one or more speakers of at least one of the headset housings. In particular, this diagram is illustrating that the ASE 20 of the left headset housing 4 is producing at least one ASE audio signal, and using (e.g., a combination of the input audio signal with) the (e.g., ASE) audio signal to drive speaker 8 to reproduce at least some of the ambient sounds captured by the microphone 7 (and/or user-desired audio content contained within the input audio signal). Thus, the controller 15 drives the speaker 8 with an audio signal, which may include the combination described herein. In another aspect, the controller may drive the speaker with the ASE audio signal or the input audio signal. In one aspect, the reference microphone 7 may be acoustically coupled to the speaker 8, such that at least some of the sound produced by the speaker is sensed by the microphone and then amplified and outputted again by the speaker. This persistent sound amplification may result in an undesirable audio howl (or "feedforward" audio howl).

The howl detector 26 is configured to detect (or determined) whether (e.g., feedforward) audio howl is present within the left headset housing 4 by comparing spectral content from the (first) error microphone signal produced by the (first) error microphone 6 and spectral content from a (second) error microphone signal produced by a (second) error microphone 9 of the right headset housing 5. More about how the detector detects audio howl is described herein. The detector includes an input audio signal remover 25, a spectral analyzer 27, and a howl candidate comparer 28. The detector is configured to obtain the error microphone signal produced by the error microphone 6, and is also configured to obtain the input audio signal from the input audio source 24.

The input audio signal remover 25 is configured to remove at least some portions of the input audio signal output (e.g., as sound) by the speaker 8 and captured by the error microphone 6, and contained within the error microphone signal. Specifically, the remover processes the error microphone signal to remove sound of the input audio signal produced by the speaker to produce an error signal. In one aspect, the remover may apply an out-of-phase version of the input audio signal (e.g., by 180°) to the error microphone signal to remove (or cancel) at least some portions of the input audio signal that are contained within the error microphone signal. As a result, the remover produces the error signal that is absent of the (at least some portions of the) input audio signal. In another aspect, the remover may perform any method (or process) to remove the (sounds of the) input audio signal contained within the error microphone signal.

The spectral analyzer 27 is configured to obtain the error signal (or the error microphone signal), and is configured to perform a spectral analysis upon the signal to detect (identify) one or more audio howl candidates. Specifically, the analyzer may generate one or more audio howl candidates that may include a portion of (or data relating to) the error signal. For example, an audio howl candidate may represent spectral content from the error signal over a frequency range that may have one or more audio howl characteristics. For example, the analyzer may analyze one or more audio frames of the error signal to determine whether a portion of the signal's spectral content is ramping up. Specifically, the analyzer may determine whether the magnitude (or SPL) of the spectral content is increasing by a threshold rate, which may be the rate above which audio howl occurs in a positive feedback loop. If so, the analyzer may define the spectral content (e.g., the magnitude and frequency range) of the error signal as an audio howl candidate. In another aspect, the spectral analyzer may define spectral content that is above a SPL threshold as an audio howl candidate. In some aspects, the spectral analyzer may analyze the entire (e.g., audible) spectrum of the error signal to identify candidates. In another aspect, the analyzer may analyze specific portions (or frequency ranges) of the error signal. The audio howl candidate may indicate the SPL of spectral content from the error signal over one or more frequency ranges. In one aspect, the SPL may be an average SPL across a given frequency range. In some aspects, the frequency range may include one or more frequencies.

In another aspect, the spectral analyzer 27 may identify audio howl candidates based on whether a confidence score is above a (e.g., predefined) threshold. The analyzer may define a potential audio howl candidate as one or more portions of spectral content of the error microphone signal, and designate the potential candidate with a confidence score based on whether the potential candidate exhibits audio howl characteristics. For example, the analyzer 27 may analyze a first audio frame (of the error signal) to determine whether spectral content has audio howl characteristics (e.g., having a SPL above a threshold value, the spectral content being within a known frequency range of audio howl, having a nearest neighbor ratio above a threshold, etc.). In one aspect, the audio howl characteristics may be predefined characteristics that are known to be associated with audio howl. If the spectral content has one or more of the audio howl characteristics, the analyzer may designate the potential audio howl candidate with a (first) confidence score. In one aspect, the more characteristics that are associated with the spectral content, the analyzers may designate a higher confidence score (than if the content was associated with less characteristics). The analyzer may then determine whether the confidence score is above a confidence score threshold. If so, the analyzer may designate the potential audio howl candidate as an audio howl candidate. If, however, the confidence score is below the threshold, the analyzer may continue to analyze future audio frames to determine whether the spectral content exceeds the threshold. For example, the analyzer may analyze a second (e.g., subsequent) audio frame to determine whether the (same) spectral content has more audio howl characteristics (e.g., the SPL now being above the threshold, the SPL is increasing by the threshold rate and is therefore ramping up, etc.). If so, the analyzer may designate the potential candidate with a (second) higher confidence score, and may designate the potential candidate as a candidate if the new confidence score exceeds the threshold. Thus, the analyzer may adjust the confidence score based on an analysis of one or more audio frames.

The howl candidate comparer 28 is configured to obtain (left headset housing) audio howl candidates from the spectral analyzer (e.g., candidates with a confidence score that exceeds the threshold) and obtain audio howl candidates from the right headset housing 5 (e.g., via a wireless connection). As described herein, a howl detector that is executing within the right headset housing may be performing similar (or the same) operations as the howl detector 26 to identify respective audio howl candidates. Thus, the right headset housing is performing a spectral analysis upon the second error (microphone) signal produced from the error microphone 9 to identify audio howl candidates, as described herein.

The howl candidate comparer 28 is configured to compare spectral content from the error (microphone) signal produced by error microphone 6 of the left headset housing 4 and spectral content from the error (microphone) signal produced by error microphone 9 of the right headset housing 5 by comparing audio howl candidates produced by both housings. Specifically, the comparer compares the left headset housing audio howl candidates with corresponding right headset housing audio howl candidates. For example, the comparer compares a first audio howl candidate identified by the spectral analyzer 27 of the left headset housing with a second audio howl candidate received from the right headset housing 6 that represents spectral content from the error microphone signal produced by error microphone 9 over a same frequency range. In other words, both candidates represent spectral content from each housing's respective error signal over the same frequency range. The comparer is determining whether the spectral content of the first audio howl candidate differs from the spectral content of the second audio howl candidate by a candidate (or first) threshold. In one aspect, the candidate threshold is a predefined threshold (e.g., SPL value). In another aspect, the candidate threshold is percentage of the SPL indicated by the left headset housing audio howl candidate. The comparer is determining whether the magnitude (e.g., SPL) of the spectral content of the first audio howl candidate is more than the SPL of the spectral content of the second audio howl candidate by the candidate threshold. If so, it is determined that audio howl is present within the left headset housing, and the howl candidate comparer designates the audio howl candidate as a final audio howl candidate. If, however, the SPL of the first audio howl candidate is less than the SPL of the second audio howl candidate by the candidate threshold, it is determined that audio howl is not present within the left headset housing. One reason for this may be that the magnitude of the spectral content represented by both audio howl candidates is the result of an external sound source.

Turning now to FIG. 2B, this figure shows audio howl mitigation operations that are performed as a result of the howl detector 26 detecting audio howl (while the audio system is operating in the first mode). Specifically, this figure illustrates that the howl mitigator 21 is in the signal path (e.g., as illustrated by the block's border changing from dotted lines to solid lines), and is configured to perform audio howl mitigation operations in order to reduce (or cancel) detected audio howl within the left headset housing 4. The mitigator is configured to obtain 1) the ASE audio signal from the ASE 20 and 2) the left headset housing final howl candidates (e.g., left headset housing candidates that differ from corresponding right headset housing candidates by the candidate threshold) from the howl candidate comparer 28, and configured to perform one or more audio signal processing operations upon the ASE audio signal based on the spectral content from the first error (microphone) signal represented by the final howl candidates.

The howl mitigator 21 includes one or more band-limited filters 22 and one or more scalar gains 23, one of which may be applied to the ASE audio signal to generate a filtered audio signal which when used to drive the speaker 8 mitigates detected audio howl. In one aspect, the howl mitigator is configured to determine which of these audio processing operations are to be applied to the ASE audio signal based on the spectral content of the obtained final audio howl candidates. Specifically, the mitigator determines whether the SPL of the spectral content from the error (microphone) signal produced by the error microphone 6 represented by one or more final audio howl candidates exceeds a (e.g., SPL) threshold. In response to determining that the SPL indicated by the final candidate exceeds the SPL threshold, the mitigator determines one or more band-limited filters to be applied to the audio signal. Specifically, the band-limited filters are adaptive filters that are generated by the mitigator based on the characteristics of the final audio howl candidates. The band-limited filter is an adaptive filter that includes a limit-band across a frequency range along which a gain reduction is to be applied to the ASE audio signal in order to limit the magnitude of the signal's spectral content across the frequency range (which may be the same frequency range across which the audio howl was detected). To generate the band-limited filter, the mitigator determines the width of the limit-band to be across the frequency range that corresponds to the frequency range of the spectral content that is represented by the final audio howl candidate. In addition, the mitigator determines the filter's gain reduction across that frequency range based on the SPL of the final audio howl candidate. In one aspect, the gain reduction is based on a difference between the SPL of the final audio howl candidate and the SPL threshold. For example, when the SPL threshold is −40 dB and the SPL of the spectral content of the final audio howl candidate is −30 dB, the gain reduction may be −10 dB.

In one aspect, the band-limited filters 22 are distinct from notch filters (or band-rejection or band-stop filters). For example, notch filters have a stop-band with a predefined frequency range, and reject all spectral content of audio signals within the stop-band, while passing through spectral content that is above and below the band. Band-limited filters as described herein, however, adaptive filters such that the frequency range of the limit-based is not predefined, but based on the frequency range represented by the final audio howl candidate. Furthermore, the gain reduction of the limit-band is not predefined (e.g., to rejection all spectral content across the band), but instead is configured to perform a gain reduction (attenuation) of the sound level within the limit band based on the difference between the SPL threshold and the SPL of the final audio howl candidates. Thus, the adapted band-limited filters may pass through at least some of the spectral content across the limit-band, while passing through most (or all) of the spectral content before and after the band.

In one aspect, the audio howl mitigator 21 is configured to apply one or more scalar gains 23. For example, in response to determining that the SPL indicated by the final candidate does not exceed the SPL threshold, the mitigator determines one or more scalar gains to be applied to the audio signal to produce the filtered audio signal. In some aspects, the scalar gains are "broadband" scalar gains such that most (or all) of the spectral content of the ASE audio signal is attenuated when applied the gain is applied to the signal. In one aspect, the scalar gain is a predefined gain value. In another aspect, the mitigator determines the scalar gain based on the final audio howl candidate (e.g., based on the difference between the SPL threshold and the SPL indicated by the final candidate).

In one aspect, the audio howl mitigator may apply one or more band-limited filters and one or more scalar gains based on the final audio howl candidates. The mitigator may obtain two final audio howl candidates. For example, based on whether the SPL indicated by each of the candidates exceeds the SPL threshold, the mitigator will determine which audio signal processing operation to apply. When a first final audio howl candidate's SPL exceeds the threshold, the mitigator may apply a band-limited filter to the ASE audio signal to limit spectral content across the frequency range indicated by the first candidate. In addition, when a second final audio howl candidate's SPL does not exceed the threshold, the mitigator may also apply a scalar gain. In some aspects, the mitigator may either apply band-limited filters or scalar gains. In another aspect, the mitigator may adapt the audio signal processing operations based on future final audio howl candidates.

Figure 3A:
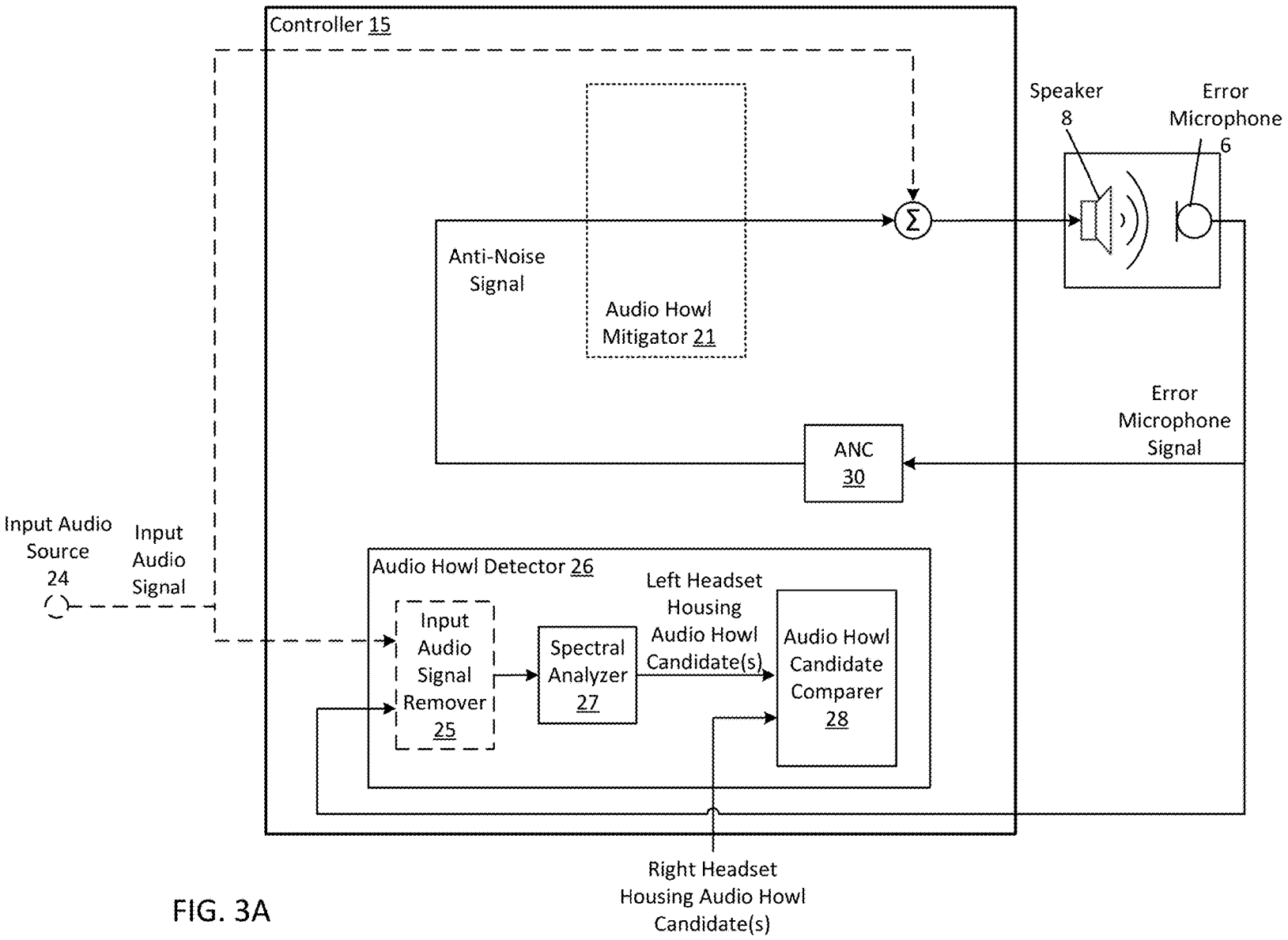
FIGS. 3A and 3B show block diagrams of a left headset housing that performs audio howl detection and mitigation according to another aspect.
Figure 3B:
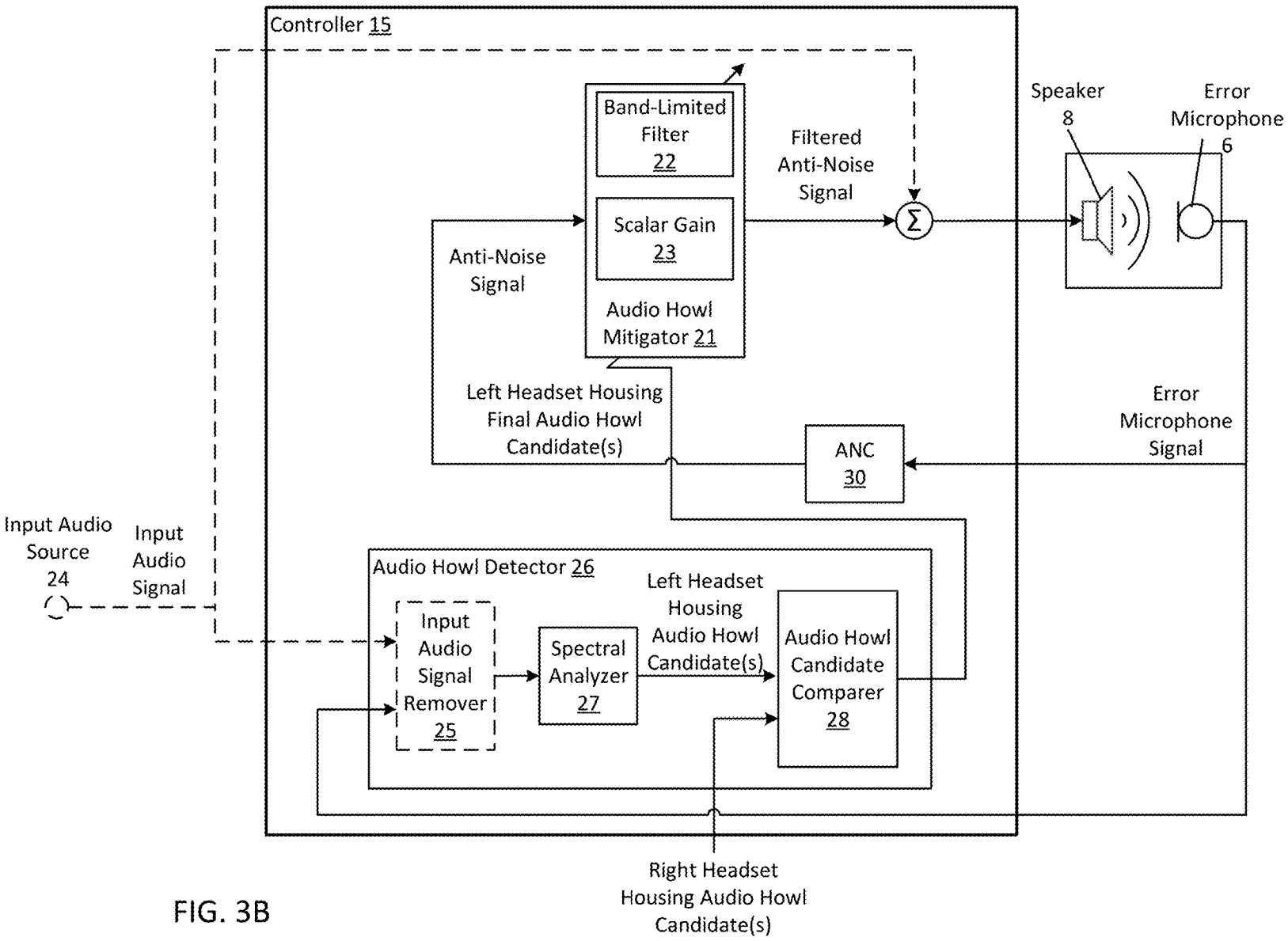

FIGS. 3A and 3B show block diagrams of a left headset housing that performs audio howl detection and mitigation according to another aspect. Specifically, FIG. 3A shows operations performed by several computational blocks similar to FIG. 2A for detecting audio howl, and FIG. 3B shows operations performed by several operational blocks similar to FIG. 2B for mitigating the detected audio howl. These figures, however, do not illustrate the reference microphone 7 and the ASE block 20, but instead includes an active noise cancellation (ANC) block 30 that is configured to produce an anti-noise signal based on background sound captured by the error microphone 6 in order to reduce or cancel the sound.

In one aspect, the ANC 30 is configured to obtain the error microphone signal from the error microphone 6 and is configured to generate the anti-noise signal by filtering the error microphone signal with one or more (e.g., ANC) filters. In one aspect, ANC may be adaptive such that the one or more filters are adapted according to an estimate of a secondary path transfer function between the speaker 8 and the error microphone 6. In some aspects, the ANC 30 may use any adaptive techniques by executing an adaptive algorithm (e.g., Least Means Squares (LMS), etc.) to adapt the filters. In another aspect, the ANC filter(s) may be a finite-impulse response filter (FIR) or an infinite impulse response (IIR) filter. In another aspect, the filter may be a cascade of one or more filters, such as a low-pass filter, a band-pass filter, and/or a high-pass filter. In one aspect, the cascade of filters may be linear filters, such that the filters may be applied in any order.

In FIG. 3A the audio system 1 may be operating in an ANC mode (second mode) in which the (e.g., one or more of the headset housings of the) headset is performing ANC operations, such that at least one of the headset housings is outputting anti-noise. In particular, this diagram is illustrating that the ANC 30 of the left headset housing 4 is producing at least one anti-noise signal, and using (e.g., a combination of the input audio signal with) the (e.g., anti-noise) signal to drive speaker 8 to reduce background sounds within the front volume of the left headset housing (and/or to output user-desired audio content contained within the input audio signal). In one aspect, the ANC 30, speaker 8, and error microphone 6 create a feedback ANC loop in which the anti-noise produced by the ANC 30 is outputted by the speaker and the ANC uses the error microphone signal produced by the error microphone to adjust the anti-noise. In some cases, sounds of the anti-noise captured by the error microphone may be amplified by the ANC 30 and outputted again by the speaker. This persistent sound amplification may result in an undesirable audio howl (or "feedback" audio howl). This figure is similar to FIG. 2A, such that the audio howl detector 26 is configured to detect whether audio howl is present based on a comparison between left headset housing audio howl candidates and right headset housing audio howl candidates.

FIG. 3B shows feedback audio howl mitigation operations that are performed by the (controller 15 of the) left headset housing 4 as a result of the howl detector 26 detecting that audio howl is present (while the audio system is operating in the second mode). Specifically, this figure shows that the howl mitigator 21 is now in the signal path between the speaker 8 and the ANC 30, and is configured to perform audio howl mitigation operations, as described herein. For instance, the audio howl mitigator filters the anti-noise signal using a band-limited filter 22 and/or scalar gain 23 based on characteristics of the spectral content that is represented by left headset housing final audio howl candidates obtained from the howl detector 26, to produce a filtered anti-noise signal.

In one aspect, the audio system may perform only one of the first and second modes at a time. In another aspect, the system may perform both of the modes at the same time. For example, the system may operate in the ASE mode and the ANC mode. As a result, the system may perform audio howl detection and mitigation operations as describe herein. Thus, when performing in both modes, an audio howl mitigator may perform mitigation operations upon the ASE signal (as illustrated in FIG. 2B), and an audio howl mitigator may perform mitigation operations upon the anti-noise signal (as illustrated in FIG. 3B).

In some aspects, the audio system 1 may operate in one or more of the modes based on a user-request. For example, the system may receive a user-request, such as a user-selection of one or more graphical user interface (GUI) items that are presented on a display screen of the audio source device 2. Each of the GUI items may be associated with one o of the modes. Once an item is selected, the audio source device may transmit a control signal to the headset, which as a result may perform (or activate) the associated operations.

In one aspect, at least some of the operations described herein are optional operations that may or may not be performed. Specifically, components and blocks that are illustrated has having dashed borders may optionally be performed. As described herein, a combination of the ASE audio signal and the input audio signal is used to drive the speaker 8, as illustrated in FIG. 2A. Thus, in this example the headset 3 is operating in the first mode, while outputting user-desired audio content retrieved (or obtained) from the input audio source 24. In one aspect, however, the headset may operate in this mode without outputting an input audio signal. In this case, the speaker 8 would not output the combination, but instead the ASE audio signal. As a result, the audio howl detector 26 would not obtain the input audio signal and would not perform removal operations in block 25. Thus, the spectral analyzer 27 obtains the error microphone signal produced by the error microphone 6, rather than the error signal.

Figure 4:
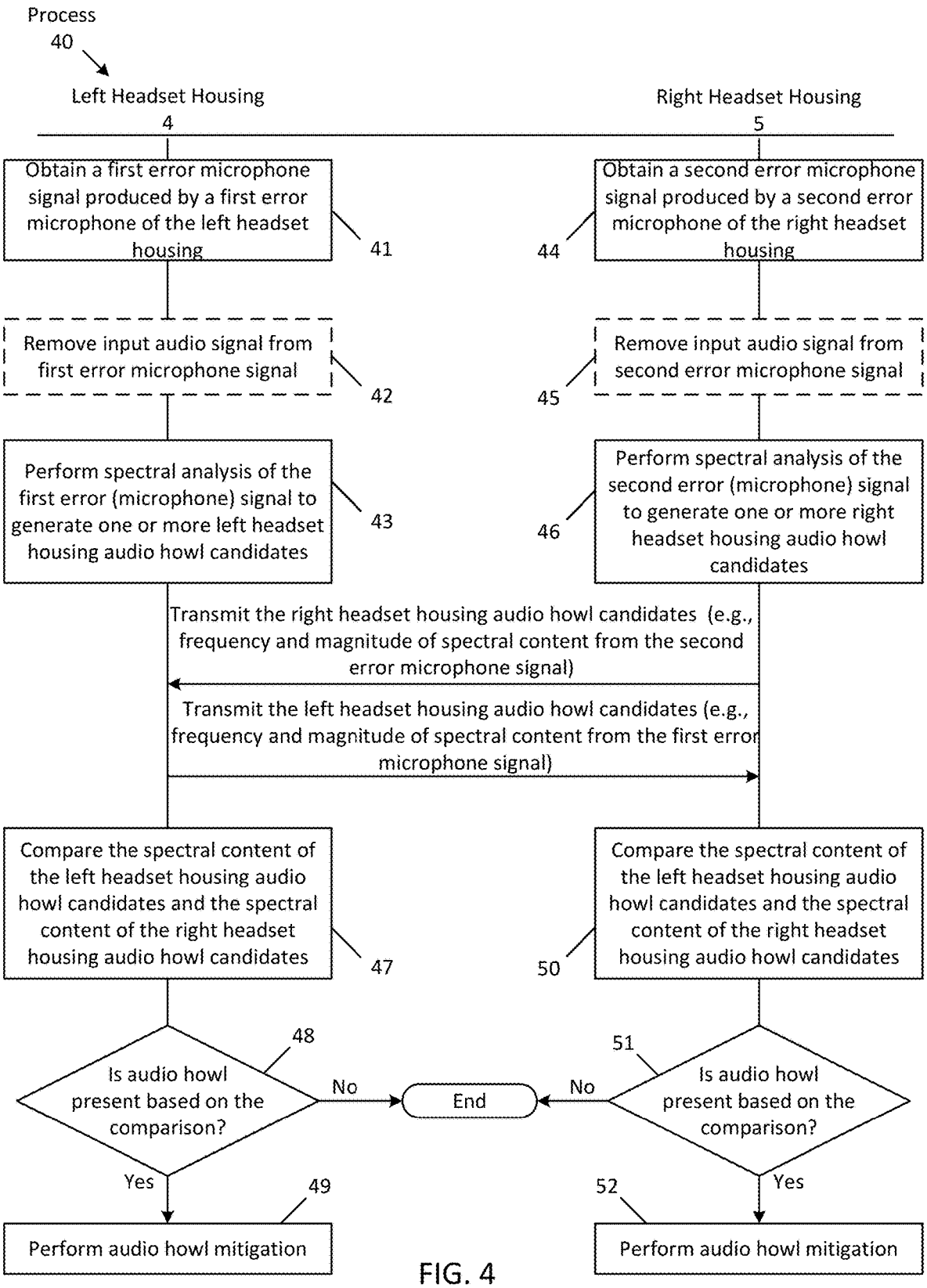
FIG. 4 is a signal diagram of one aspect of a process to detect audio howl.
Figure 5:
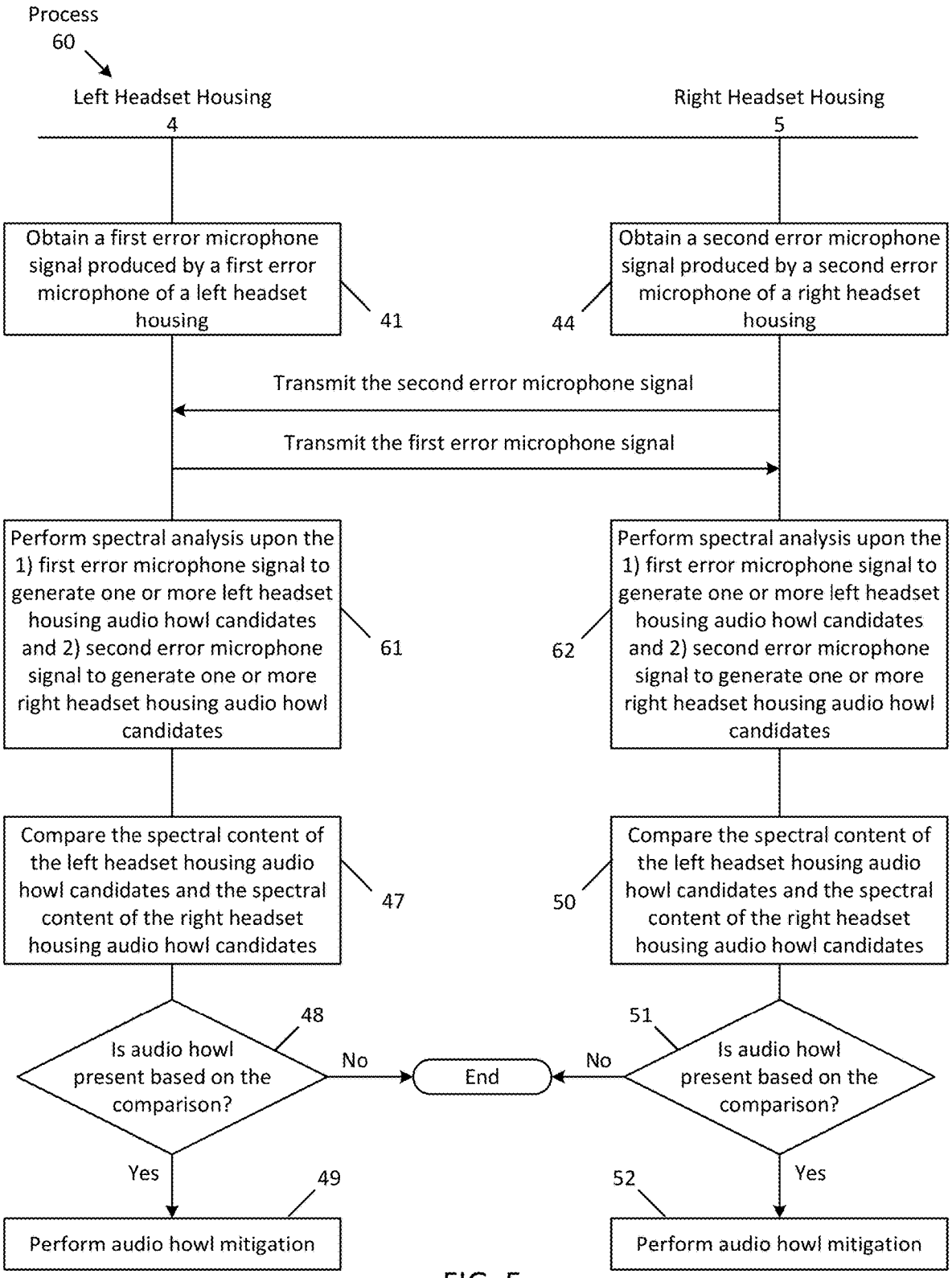
FIG. 5 is a signal diagram of another aspect of a process to detect audio howl.

FIGS. 4 and 5 are signal diagrams of processes to detect audio howl. In one aspect, these processes may be performed by the (e.g., headset 3 of the) audio system 1 illustrate din FIG. 1. Specifically, each of these processes are performed by one or more controllers (or processors), of each of the headset housings 4 and 5 (such as controller 15 of housing 4).

Turning to FIG. 4, this figure is a signal diagram of one aspect of a process 40 to detect audio howl. The process 40 begins by the controller 15 of the left headset housing 4 obtaining a first error microphone signal produced by a first error microphone 6 of the left headset housing (at block 41). The controller removes an input audio signal from the first error microphone signal to produce a first error signal (at block 42). As described herein, the (controller of the) left headset housing may output the input audio signal via the speaker 8. In this block, sound of the input audio signal is removed from the error microphone signal. The controller performs spectral analysis of the first error (microphone) signal to generate one or more left headset housing audio howl candidates (at block 43). As described herein, the spectral analyzer identifies audio howl candidates based on whether a confidence score is above a confidence score threshold.

As described herein, a controller (hereafter referred to as "second controller") of the right headset housing 5 may perform similar operations. In one aspect, the controller 15 of the left headset housing may perform these operations, and/or another (second) controller (which may be integrated within the right headset housing) may perform at least some of these operations. In another aspect, the controller 15 may perform all (or at least some) of the operations associated with both headset housings, as describe herein. For instance, the second controller obtains a second error microphone signal produced by a second error microphone 9 of the right headset housing (at block 44). The second controller removes an input audio signal from the second error microphone to produce a second error signal (at block 45). In one aspect, the left and right headset housings may be outputting the same or different input audio signal. For example, when the headset is outputting stereo sound, the input audio signal removed from the right headset housing is a right audio channel (while similarly, the input audio signal removed by the left headset housing is the left audio channel). The second controller performs spectral analysis of the second error (microphone) signal to generate one or more right headset housing audio howl candidates (at block 46).

In one aspect, blocks 42 and 45 are optional blocks that are based on whether the headset is outputting user-desired audio content (e.g., based on whether each headset housing is receiving an input audio signal for output through a respective speaker). If not, the process 40 performed by the left headset housing 4 proceeds from block 41 to block 43, and similarly the process performed by the right headset housing 5 proceeds from block 44 to block 46.

Both headset housings transmit their respective generated audio howl candidates to the other headset housing. For instance, the right headset housing 5 transmits the right headset housing audio howl candidates to the left headset housing, and vice a versa. Both headset housings then use the candidates to determine whether audio howl is present. For example, the controller 15 compares the spectral content (e.g., a first SPL) of the left headset housing audio howl candidates with the spectral content (e.g., a second SPL) of right headset housing audio howl candidates (at block 47). The controller 15 determines whether audio howl is present within the left headset housing based on the comparison (at decision block 48). In response to determining that audio howl is present, the controller 15 performs audio howl mitigation, as described herein (at block 49). Specifically, audio howl mitigator 21 filters (e.g., applies one or more band-limited filters 22 and/or one or more scalar gains 23) the audio signal (e.g., the ASE signal and/or the anti-noise signal) to mitigate the audio howl, as described herein. More about performing audio howl mitigation is described in FIG. 6.

The second controller of the right headset housing 5 also compares the spectral content of the left headset housing audio howl candidates and the spectral content of the right headset housing audio howl candidates (at block 50). The second controller determines whether audio howl is present based on the comparison (at decision block 51), and performs audio howl mitigation in response to howl being present (at block 52).

In one aspect, controllers of both headset housings may perform their respective operations in process 40 contemporaneously with one another. For example, the controller 15 may perform operations 41-43 (at least partially) contemporaneously while the second controller of the right headset housing 5 performs operations 44-46. In another aspect, these operations may be performed at different times. In yet another aspect, the controller 15 may perform all of the operations.

Turning to FIG. 5, this figure is a signal diagram of another aspect of a process 60 to detect audio howl. The process 60 includes similar operations as process 40 of FIG. 4, except that rather than each (controller) of the headset housings transmitting their respective audio howl candidates, the controllers are transmitting (e.g., raw) error microphone signals (or error signals) such that both housings generate two sets of audio howl candidates. Specifically, the controller 15 of the left headset housing 4 obtains the first error microphone signal produced by the first error microphone 6 (at block 41), and transmits the first error microphone signal to the right headset housing 5. In addition, the second controller right headset housing 5 obtains the second error microphone signal (at block 44), and transmits the second error microphone signal to the left headset housing 4.

Each of the controllers of the headset housings performs spectral analysis upon both the first and second error microphone signals. In particular, the controller 15 of the left headset housing 4 performs spectral analysis 1) upon the first error microphone signal to generate one or more left headset housing audio howl candidates and 2) upon the second error microphone signal to generate one or more right headset housing audio howl candidates (at block 61). In addition, the second controller of the right headset housing 5 performs similar operations at block 62. Both controllers then perform operations 47-52, as described in FIG. 4. Thus, rather than (or in addition to) sending audio howl candidates, each of the headset housings may transmit their respective error microphone signals.

In one aspect, (at least one of) the controllers of the headset housings may transmit error signals. For example, when the left headset housing 4 is outputting an input audio signal, the input audio signal remover may remove sounds of the input audio signal captured by the error microphone 6 from the (first) error microphone signal to produce a (first) error microphone, as described herein. Once removed, the left headset housing may transmit the resulting first error signal to the right headset housing.

Figure 6:
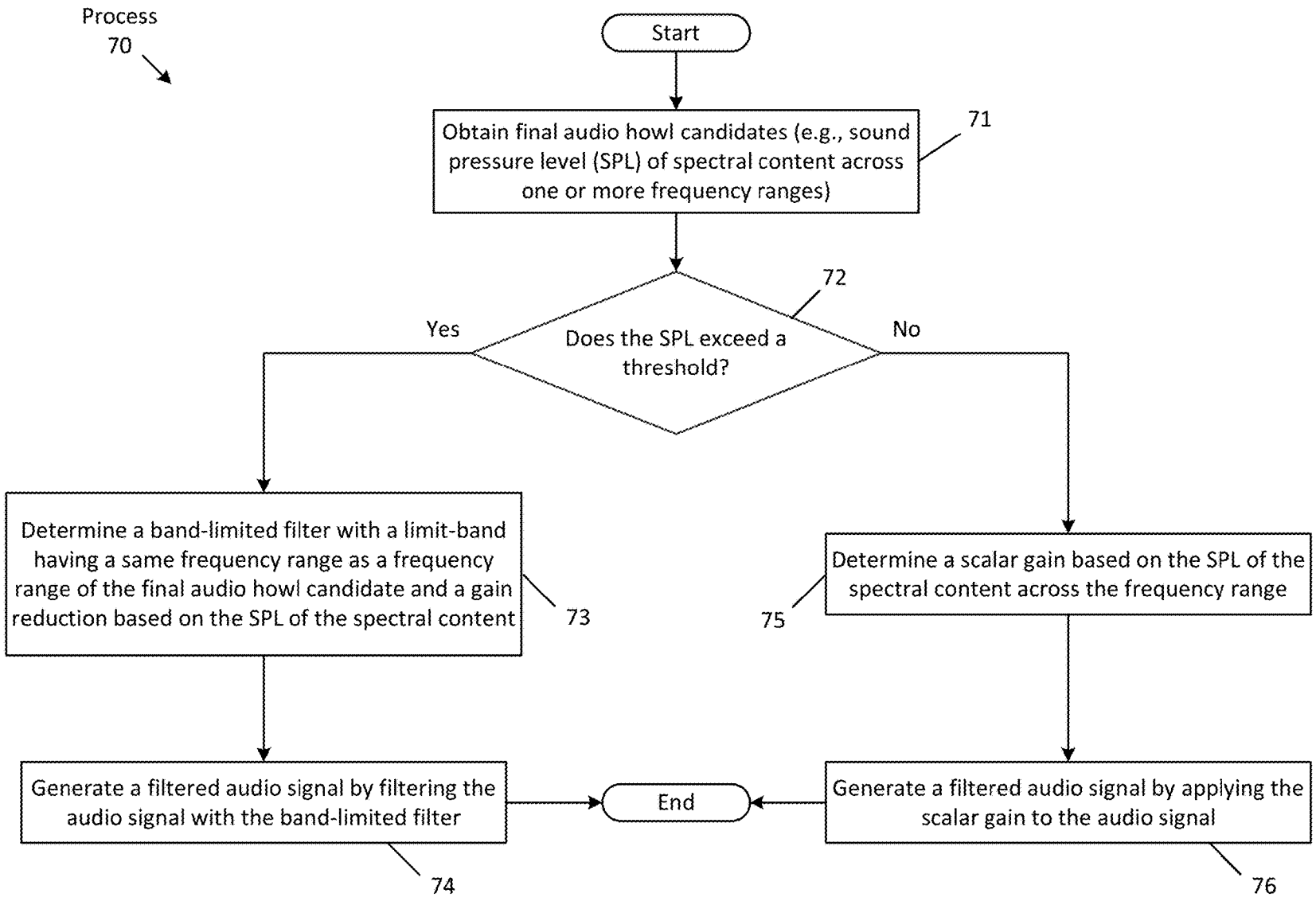
FIG. 6 is a flowchart of one aspect of a process to mitigate audio howl.

FIG. 6 is a flowchart of one aspect of a process 70 to mitigate audio howl. In one aspect, the operations of this process may be performed in response to determining that audio howl is present (e.g., in the left headset housing). In one aspect, this process may be performed by either headset housing's controller (or may be performed by a single controller, such as controller 15, for example at block 49 for the left headset housing 4 and at block 52 for the right headset housing 5 as described in FIGS. 4 and 5. Specifically, at least at least some of the operations may be performed by an audio howl mitigator 21 of either headset housing's controllers, as described herein.

The process 70 begins by obtaining one or more final audio howl candidates, where each final candidate representing spectral content of an error (microphone) signal (at block 71). As an example, for the left headset housing 4, the mitigator 21 obtains left headset housing final audio howl candidates, where each final candidate indicating a SPL of the error (microphone) signal produced by the error microphone 6 across one or more frequency ranges, as described herein. The process 70 determines whether the SPL exceeds the SPL threshold (at decision block 72). In one aspect, the mitigator may perform this determination for each final candidate. If the SPL does exceed the threshold, the process 70 determines a band-limited filter with a limit-band having a same frequency range as a frequency range of the final audio howl candidate and a gain reduction based on the SPL of the spectral content for which the final candidate represents (at block 73). As described herein, the gain reduction may be based on the difference between the SPL and the SPL threshold. The process 70 generates a filtered audio signal (e.g., a filtered ASE signal and/or a filtered anti-noise signal, based on what mode the audio system 1 is in) by filtering the audio signal with the band-limited filter (at block 74).

If, however, the SPL does not exceed the SPL threshold, the process 70 determines a scalar gain based on the SPL of the spectral content for which the final candidate represents (at block 75). For example, the scalar gain may be based on a percentage of the SPL value. As another example, the scalar gain may be based on the difference between the SPL and the SPL threshold. The process 70 generates a filtered audio signal (e.g., a gain-reduced audio signal) by applying the scalar gain to the audio signal (at block 76).

In one aspect, at least some of the operations of process 70 may be performed for each one of the one or more final audio howl candidates, where each candidate may represent a different portion of spectral content (e.g., over a different frequency range) of the error microphone signal. Thus, the controller 15 may apply one or more band-limited filters and/or one or more scalar gains based on whether each of the candidates exceeds the SPL threshold.

Some aspects may perform variations to the processes 40, 60, and 70 described in FIGS. 4-6. For example, the specific operations of at least some of the processes may not be performed in the exact order shown and described. The specific operations may not be performed in one continuous series of operations and different specific operations may be performed in different aspects. For example, the detection and mitigation operations may only be performed by one of the headset housings. In that case, the other headset housing may transmit its audio howl candidates (and/or error microphone signal), while not performing any additional operations.

In one aspect, at least some of the operations of the processes 40, 60, and/or 70 may be performed by a machine learning algorithm (which may include one or more neural networks, such as convolution neural networks, recurrent neural networks, etc.) that is configured to automatically (e.g., without user intervention) detect and mitigate audio howl.

Personal information that is to be used should follow practices and privacy policies that are normally recognized as meeting (and/or exceeding) governmental and/or industry requirements to maintain privacy of users. For instance, any information should be managed so as to reduce risks of unauthorized or unintentional access or use, and the users should be informed clearly of the nature of any authorized use.

As previously explained, an aspect of the disclosure may be a non-transitory machine-readable medium (such as microelectronic memory) having stored thereon instructions, which program one or more data processing components (generically referred to here as a "processor") to perform the network operations, audio signal processing operations, audio howl detection operations, and/or audio howl mitigation operations, as described herein. In other aspects, some of these operations might be performed by specific hardware components that contain hardwired logic. Those operations might alternatively be performed by any combination of programmed data processing components and fixed hardwired circuit components.

While certain aspects have been described and shown in the accompanying drawings, it is to be understood that such aspects are merely illustrative of and not restrictive on the broad disclosure, and that the disclosure is not limited to the specific constructions and arrangements shown and described, since various other modifications may occur to those of ordinary skill in the art. The description is thus to be regarded as illustrative instead of limiting.

In some aspects, this disclosure may include the language, for example, "at least one of [element A] and [element B]." This language may refer to one or more of the elements. For example, "at least one of A and B" may refer to "A," "B," or "A and B." Specifically, "at least one of A and B" may refer to "at least one of A and at least one of B," or "at least of either A or B." In some aspects, this disclosure may include the language, for example, "[element A], [element B], and/or [element C]." This language may refer to either of the elements or any combination thereof. For instance, "A, B, and/or C" may refer to "A," "B," "C," "A and B," "A and C," "B and C," or "A, B, and C."

What is claimed is:

1. A method performed by a headset with a left headset housing and a right headset housing, the method comprising:

driving a speaker of the left headset housing with an audio signal;

determining whether audio howl is present within the left headset housing by comparing spectral content from a first error microphone signal produced by a first error microphone of the left headset housing and spectral content from a second error microphone signal produced by a second error microphone of the right headset housing; and in response to determining that audio howl is present, filtering the audio signal to mitigate the audio howl.

2. The method of claim 1 further comprising generating the audio signal by filtering a reference microphone signal produced by a reference microphone of the left headset housing with an ambient sound enhancement (ASE) filter.

3. The method of claim 1 further comprising generating an anti-noise signal as the audio signal by filtering the first error microphone signal produced by the first error microphone.

4. The method of claim 3 further comprising obtaining an input audio signal that contains user-desired audio content;

driving the speaker with a combination of the anti-noise signal and the input audio signal to produce sound, wherein the first error microphone is arranged to capture and convert the sound into the first error microphone signal; and processing the first error microphone signal to remove sound of the input audio signal produced by the speaker to produce an error signal, wherein the determination of whether audio howl is present is based on a comparison of spectral content from the error signal and spectral content from the second error microphone signal.

5. The method of claim 1, wherein determining whether the audio howl is present comprises generating, using the first error microphone signal, a first audio howl candidate that represents spectral content from the first error microphone signal over a frequency range;

comparing the first audio howl candidate with a second audio howl candidate representing spectral content from the second error microphone signal over the frequency range; and determining whether the spectral content of the first audio howl candidate differs from the spectral content of the second audio howl candidate by a threshold.

6. The method of claim 5 further comprising obtaining, from the right headset housing, the second audio howl candidate.

7. The method of claim 5 further comprising obtaining, from the right headset housing, the second error microphone signal; and generating, using the second error microphone signal, the second audio howl candidate.

8. An in-ear headphone comprising:

a speaker of a first headphone housing;

a first error microphone of the first headphone housing;

a second error microphone of a second headphone housing;

a processor; and memory having instructions which when executed by the processor causes the first in-ear headphone to:

drive the speaker with an audio signal;

determine whether audio howl is present within the first headphone housing by comparing spectral content from a first error microphone signal produced by the first error microphone and spectral content from a second error microphone signal produced by the second error microphone; and in response to determining that audio howl is present, filter the audio signal to mitigate the audio howl.

9. The in-ear headphone of claim 8 further comprises a reference microphone of the first headphone housing, wherein the memory has further instructions to generate the audio signal by filtering a reference microphone signal produced by the reference microphone with an ambient sound enhancement (ASE) filter.

10. The in-ear headphone of claim 8, wherein the memory has further instructions to generate an anti-noise signal as the audio signal by filtering the first error microphone signal produced by the first error microphone.

11. The in-ear headphone of claim 10, wherein the memory has further instructions to obtain an input audio signal that contains user-desired audio content;

drive the speaker with a combination of the anti-noise signal and the input audio signal to produce sound, wherein the first error microphone is arranged to capture and convert the sound into the first error microphone signal; and process the first error microphone signal to remove sound of the input audio signal produced by the speaker to produce an error signal, wherein the determination of whether audio howl is present is based on a comparison of spectral content from the error signal and spectral content from the second error microphone signal.

12. The in-ear headphone of claim 8, wherein the instructions to determine whether the audio howl is present comprises instructions to generate, using the first error microphone signal, a first audio howl candidate that represents spectral content from the first error microphone signal over a frequency range;

compare the first audio howl candidate with a second audio howl candidate representing spectral content from the second error microphone signal over a same frequency range; and determine whether the spectral content of the first audio howl candidate differs from the spectral content of the second audio howl candidate by a threshold.

13. The in-ear headphone of claim 12, wherein the memory has further instructions to obtain, from the second headphone housing, the second audio howl candidate.

14. The in-ear headphone of claim 12, wherein the memory has further instructions to obtain, from the second headphone housing, the second error microphone signal; and generate, using the second error microphone signal, the second audio howl candidate.

15. A method performed by a headset with a left headset housing and a right headset housing, the method comprising:

driving a speaker of the left headset housing with an audio signal;

determining that audio howl is present within the left headset housing based on a comparison of spectral content from a first error microphone signal produced by a first error microphone of the left headset housing and spectral content from a second error microphone signal produced by a second error microphone of the right headset housing;

in response to determining that audio howl is present, determining whether a sound pressure level (SPL) of the spectral content from the first error microphone signal exceeds a threshold;

in response to the SPL exceeding the threshold determining a band-limited filter with a gain reduction based on the SPL of the spectral content from the first error microphone signal; and generating a filtered audio signal by filtering the audio signal with the band-limited filter.

16. The method of claim 15, wherein the spectral content from the first error microphone signal is within a frequency range of the first error microphone signal, wherein the band-limited filter has a limit-band across the frequency range over which the gain reduction is applied to the audio signal.

17. The method of claim 15, wherein, in response to the SPL being below the threshold, generating a filtered audio signal by applying a scalar gain to the audio signal.

18. The method of claim 15, wherein the SPL is a first SPL, wherein determining that the audio howl is present comprises generating, using the first error microphone signal, a first audio howl candidate that represents the spectral content from the first error microphone signal with the first SPL over a frequency range;

obtaining, from the right headset housing, a second audio howl candidate representing spectral content from the second error microphone signal with a second SPL over the frequency range; and determining that the first SPL of the first audio howl candidate exceeds the second SPL of the second audio howl candidate by a candidate threshold.

19. The method of claim 18, wherein the gain reduction of the band-limited filter is based on a difference between the first SPL and the threshold, and the band-limited filter has a limit-band across the frequency range over which the gain reduction is applied to the audio signal.

20. The method of claim 19, wherein the band-limited filter is a first band-limited filter, the gain reduction is a first gain reduction, the limit-band is a first limit-band, and the frequency range is a first frequency range, wherein the method further comprises generating, using the first error microphone signal, a third audio howl candidate that represents the spectral content from the first error microphone signal with a third SPL over a second, different frequency range;

obtaining, from the right headset housing, a fourth audio howl candidate representing spectral content from the second error microphone signal with a fourth SPL over the second frequency range;

in response to determining that the third SPL of the third audio howl candidate exceeds the fourth SPL of the fourth audio howl candidate by the candidate threshold, determining whether the third SPL exceeds the threshold; and in response to the third SPL exceeding the threshold, determining a second band-limited filter with a second limit-band across a second frequency range over which a second gain reduction is to be applied to the audio signal, wherein the filtered audio signal is generated by filtering the audio signal with the first and second band-limited filters.

21. The method of claim 20, wherein the first frequency range and the first gain reduction of the first band-limited filter are different than the second frequency range and the second gain reduction of the second band-limited filter, respectively.

* * * * *